United States Patent [19]

Simon et al.

[11] 4,114,013

[45] Sep. 12, 1978

[54] CHOKE FOR COMBINED MICROWAVE AND SELF-CLEANING OVEN

[75] Inventors: Donald J. Simon; Louis H. Fitzmayer, both of Louisville, Ky.

[73] Assignee: General Electric Company, Louisville, Ky.

[21] Appl. No.: 819,789

[22] Filed: Jul. 28, 1977

[51] Int. Cl.[2] ..... H05B 9/06

[52] U.S. Cl. ..... 219/10.55 D; 126/198

[58] Field of Search ..... 219/10.55 D, 10.55 R; 126/200, 194, 193, 198

[56] References Cited

U.S. PATENT DOCUMENTS

| | | | |
|---|---|---|---|
| 3,177,334 | 4/1965 | Kinkle | 219/10.55 D |
| 3,584,177 | 6/1971 | Bucksbaum | 219/10.55 D |
| 3,668,357 | 6/1972 | Kobayashi | 219/10.55 D |
| 3,809,843 | 5/1974 | Takayama | 219/10.55 D |
| 3,812,316 | 5/1974 | Milburn | 219/10.55 D |
| 3,846,608 | 11/1974 | Vera Valles | 219/10.55 D |
| 4,059,742 | 11/1977 | Baron | 219/10.55 D |

OTHER PUBLICATIONS

Kusunoki, S. et al., National Technical Report, vol. 22, No. 2, pp. 177–186, Apr. 1976.

*Primary Examiner*—Arthur T. Grimley
*Attorney, Agent, or Firm*—Francis H. Boos

[57] ABSTRACT

A combined microwave and self-cleaning oven has a choke surrounding the oven liner with the opening of the choke cavity adjacent the lip of the liner. The choke cavity has a rib at each of several groundpoints to trap air within the cavity. This trapped air thermally insulates the oven liner lip region so that pyrolytic self-cleaning of the oven can be accomplished without the aid of a mullion heater. For best electrical effectiveness, the choke groundpoints are preferably spaced a distance of between one-half and one wavelength.

9 Claims, 4 Drawing Figures

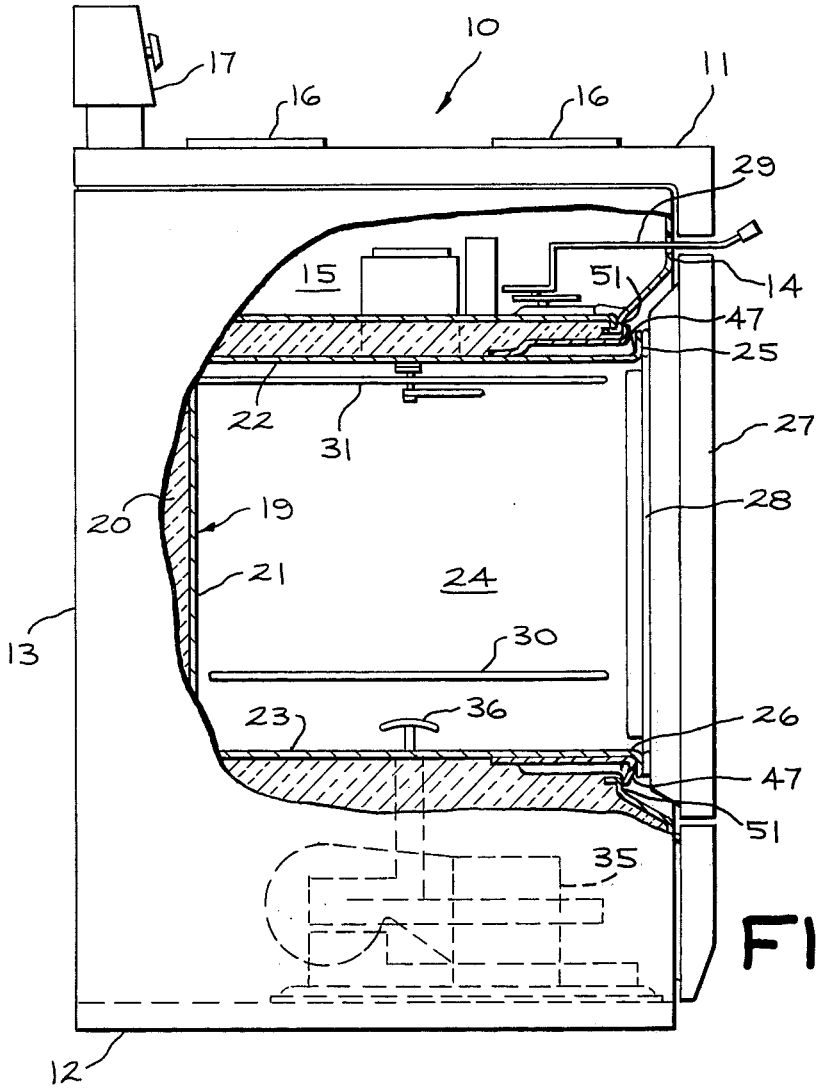
FIG. 1
FIG. 3
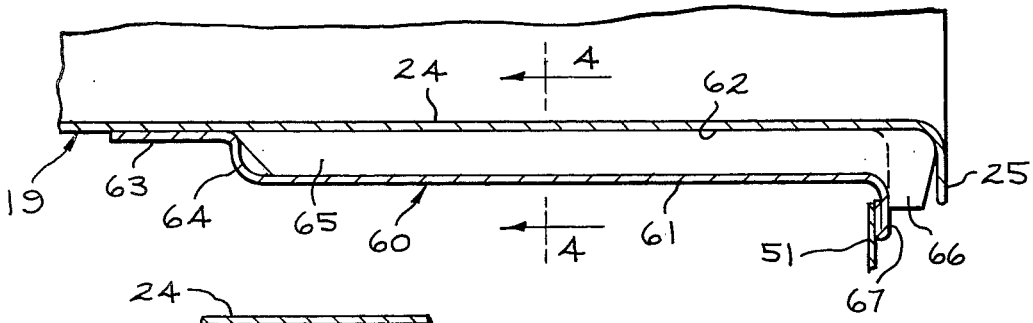
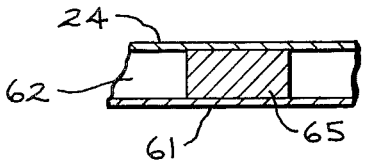
FIG. 4

CHOKE FOR COMBINED MICROWAVE AND SELF-CLEANING OVEN

BACKGROUND OF THE INVENTION

1. Field of the Invention

This invention relates generally to a door seal choke for a combined microwave and self-cleaning oven and, more particularly, to such a choke which functions both as a thermal insulator during pyrolytic self-cleaning of the oven and to reduce leakage of microwave energy.

2. Description of the Prior Art

In U.S. Pat. No. 3,812,316 to Milburn, there is shown a combined microwave and self-cleaning oven having a metal mesh gasket on the door for sealing against the lip of the oven liner. This gasket seals the opening of the liner not only to prevent the escape of heat, gases, and smoke, but also to prevent the escape of microwave energy.

As set forth in the aforesaid Milburn patent, pyrolytic self-cleaning of the oven can be accomplished by the apparatus and process disclosed in U.S. Pat. No. 3,121,158 to Hurko. In the aforesaid Hurko patent, it is necessary for a mullion heater to be provided around the liner of the oven adjacent the lip of the oven to compensate for heat losses at the door of the oven.

In the construction of microwave ovens, it has become usual to employ choke type microwave energy seals around the door opening. Such chokes typically have a depth of either one-fourth or one-half wavelength and operate either to produce a low impedance to effectively short circuit possible leakage of microwave energy, or to produce a high impedance to effectively block possible microwave energy leakage, depending upon the particular design.

SUMMARY OF THE INVENTION

It is an object of this invention to provide a choke structure for a combined microwave and self-cleaning oven in which the choke both serves as a backup microwave energy seal for the primary metal mesh gasket seal, and provides thermal insulation to compensate for heat losses adjacent the door during pyrolytic self-cleaning.

This and other objects are accomplished by the present invention in which a combined microwave and self-cleaning oven includes an oven liner having an opening with a lip surrounding the periphery of the opening of the liner. Microwave energy of a selected wavelength is introduced into the liner. A door has sealing means for engaging the liner lip when the door is in its closed position to seal the opening. A choke, which surrounds the liner adjacent the lip, has means for trapping air to thermally insulate the liner adjacent the lip during pyrolytic cleaning of the liner. Preferably, the choke cavity has a height selected to prevent propagation of any tranverse magnetic mode within the choke cavity. The choke cavity has rib groundpoints at a selected distance from each other to serve as the air trapping means and to permit propagation of only one transverse electric mode within the choke cavity.

BRIEF DESCRIPTION OF THE DRAWINGS

The attached drawings illustrate preferred embodiments of the invention, in which:

FIG. 1 is an elevational view, partly in section, of a combined microwave and self-cleaning oven having the choke of the present invention;

FIG. 3 is a fragmentary sectional view of a portion of an oven liner having a modification of the choke of the present invention; and FIG. 4 is a fragmentary sectional view taken along line 4—4 of FIG. 3 showing the rib insert of FIG. 3.

DESCRIPTION OF THE PREFERRED EMBODIMENTS

Figure 2:
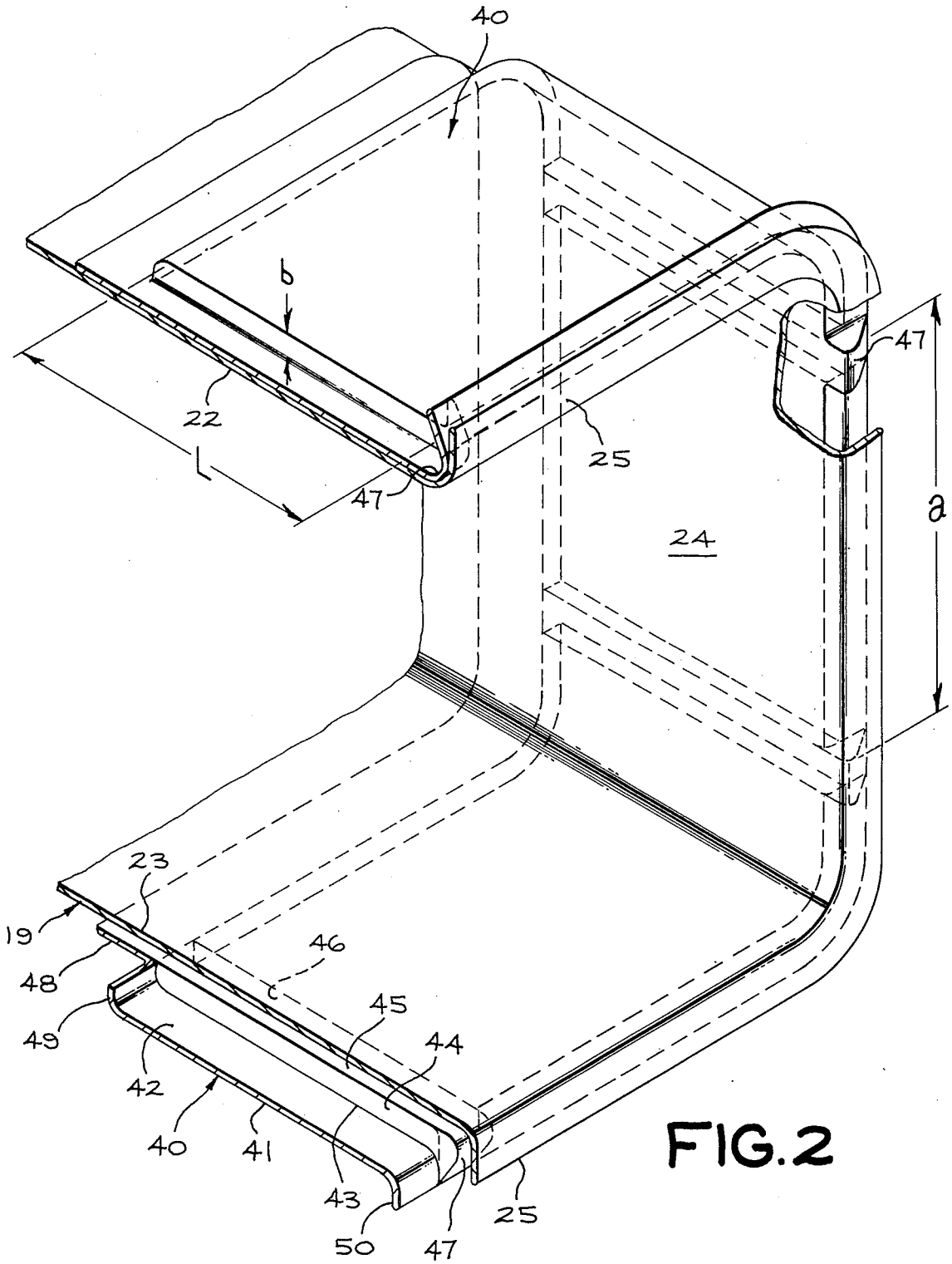
FIG. 2 is a fragmentary perspective view, partly in section, of a portion of the liner of the oven of FIG. 1 showing the choke of the present invention in more detail.

Referring now to the drawings and particularly FIG. 1, there is shown an electric range 10, which is similar to that shown and described in U.S. Pat. No. 3,823,295 issued to us. The range 10 includes a top wall 11, a bottom wall 12, an upstanding rear wall 13, a front wall 14, and a pair of opposed upstanding side walls 15.

A plurality of standard electrical resistance surface heating units 16 is mounted on the top wall of the range 10. The units 16 and other heating apparatus of the range 10 are controlled by a set of controls, which are carried by a panel 17 mounted on the top wall 11 at the rear end thereof.

A substantially box-shaped metal liner 19 is housed within the range 10. The liner 19 is surrounded by batts 20 of insulation.

The liner 19 includes a rear wall 21, a top wall 22, a bottom wall 23, and a pair of substantially parallel side walls 24. The front ends of the top wall 22, the bottom wall 23, and the side walls 24 terminate in a lip 25, which surrounds an opening 26 of the liner 19.

A door 27 is mounted on the front wall 14 of the range 10 for movement between an open position (not shown) and its closed position of FIG. 1 in which a metal mesh gasket 28 on the door 27 engages the lip 25 of the liner 19 to seal the opening 26. The gasket 28 is preferably of the type more particularly shown and described in the aforesaid Milburn patent. The door 27 is retained in its closed position by a latch assembly 29.

As more particularly shown and described in our aforesaid patent, a rack 30 is mounted within the oven liner 19. As more particularly shown and described in our aforesaid patent, a broil unit 31 is mounted adjacent the top wall 22 of the oven liner 19.

A magnetron 35 is mounted beneath the bottom wall 23 of the liner 19 within a lower machinery compartment of the range 10. As more particularly shown and described in our aforesaid patent, the magnetron 35 is connected to an antenna 36, which is mounted within the liner 19. Accordingly, the magnetron 35 generates electromagnetic energy of a predetermined ultra high frequency, for example 915 MHz, with the antenna 36 radiating this energy within the liner 19.

As best seen in FIG. 2, a metallic member 40 is mounted on the outer surface of the liner 19 adjacent the lip 25. The metallic member 40 includes a portion 41 disposed in spaced relation to the walls 22–24 of the liner 19 to form a choke cavity 42 therebetween in surrounding relation to the liner 19.

The choke cavity 42 opens into the space between the flange 50 and the liner lip 25, just outside of the metal-to-metal seal produced by the metal mesh gasket 28 contacting the liner lip 25. The dimensions of the choke cavity 42, hereinafter more fully described, are such that a high impedance to microwave energy is presented at the opening, tending to block any microwave energy which might escape past the primary metal mesh gasket seal.

The portion 41 of the metallic member 40 is disposed much less than a distance of one-quarter of a guide wavelength from each of the walls 22–24 of the liner 19. In the event microwave energy leaks beyond the primary metal mesh gasket seal, this ensures that only transverse electric field waves can exist within the choke cavity 42.

The portion 41 of the metallic member 40 is pushed inwardly to form a number of ribs 43, each rib being a groundpoint within the choke cavity 42. The groundpoints of the choke cavity 42 preferably are disposed a predetermined distance from each other so that only the $TE_{10}$ mode can propagate within the choke cavity 42. Preferably, the groundpoints are spaced from each other a distance equal to the wavelength in air of the microwave freqency produced by the magnetron 35, and in any event within the range of from one-half to one of a free space wavelength of the microwave frequency produced by the magnetron 35.

Each of the ribs 43 includes a first portion 44, which is perpendicular to the portion 41, a second portion 45, which is parallel to the portion 41 and can either engage one of the walls 22–24 of the liner 19 or be slightly spaced therefrom, and a third portion 45, which is parallel to the first portion 44. Each of the ribs 43 also has a protrusion or extension 47, which contacts the lip 25 of the liner 19.

Thus, the ribs 43, which are disposed at the groundpoints of the choke cavity 42, trap air within the choke cavity 42 between the ribs 43. This trapped air serves as a thermal insulator during pyrolytic self-cleaning of the oven liner 19 in the manner shown and described in the aforesaid Hurko patent. Specifically, the trapped air reduces heat losses from the liner lip 25, eliminating the need for the mullion heater of the Hurko patent.

The metallic member 40 also includes a rear mounting flange 48, which is connected to the portion 41 by a portion 49, which forms the rear wall of the choke cavity 42. The rear mounting flange 48 is secured to the outer surfaces of the walls 22, 23, and 24 of the liner 19 by welding, for example, to secure the metallic member 40 to the liner 19.

The metallic member 40 has a front mounting flange 50, which is interrupted by the ribs 43, secured to a mounting flange 51 (see FIG. 1) of the front wall 14 of the range 10. Thus, the oven liner 19 is secured to the front wall 14 of the range 10 by the metallic member 40.

In order for the choke to be most effective, the dimensions of the choke cavity 42 are preferably selected with respect to the wavelength, λ, corresponding to the microwave frequency in the manner which will now be described. By way of example, for 915 MHz, λ (free space) is 12.8 inches.

The choke cavity is considered as a rectangular waveguide, with the direction of propagation being into the cavity at right angles to the choke cavity opening. Referring to FIG. 2, in accordance with usual waveguide nomenclature, the "*a*," or wider, dimension is the distance between the groundpoints defined by the ribs 43. The "*b*," or narrower, dimension is the height of the choke cavity.

Preferably, only the dominant, or $TE_{10}$, mode is permitted to exist. Accordingly, the "*a*" dimension is selected to be between λ/2 and λ. For this example, a = λ is selected. The "*b*" dimension is selected to be less than λ/4. Such a "*b*" dimension ensures that no TM mode can exist within the choke cavity. In further accordance with usual nomenclature, for a $TE_{10}$ mode, $m = 1$ (the number of standing wave variations in the direction of the "*a*" dimension), and $n = 0$ (the number of standing wave variations in the direction of the "*b*" dimension).

To present a high impedance at the entrance to the choke cavity, the length or "L" dimension from the portion 49 to the front mounting flange 50 (FIG. 2) should approximately equal an odd integer multiple of a quarter wavelength. The short circuit at the termination formed by the portion 49 will thus be transformed to a high impedance. Since the choke cavity 42 behaves as a waveguide, guide wavelength not free space wavelength, must be considered. Specifically, in this example, $L = \lambda_g/4$. This should also be the approximate distance from the door gasket 28 (FIG. 1) to the exterior of the range 10.

To get $\lambda_g$, we first need cutoff wavelength, $\lambda_c$:

$$\lambda_c = \frac{2}{\sqrt{\left(\frac{m}{a}\right)^2 + \left(\frac{n}{b}\right)^2}} = \frac{2}{\sqrt{\left(\frac{1}{a}\right)^2 + \left(\frac{0}{b}\right)^2}} = 2a$$

Guide wavelength, $\lambda_g$, within the choke cavity 42 for a $TE_{10}$ mode is then:

$$\lambda_g = \frac{\lambda}{\sqrt{e - \left(\frac{\lambda}{\lambda_c}\right)^2}} = \frac{2\lambda}{\sqrt{3}} = 14.78 \text{ inches}$$

where:

*e*, dielectric constant, = 1 for air, $\lambda_c = 2a = 2\lambda$, and $\lambda = 12.8$ inches then $L = \lambda_g/4 = 14.78/4 = 3.7$ inches.

Summarizing the foregoing, in this example preferred dimensions are as follows:

*a* (groundpoint spacing) = λ = 12.8 inches

*b* (choke height) is much less than λ/4 or much less than 3.2.

In a preferred design, "*b*" was 0.15 inch.

L (choke length) = 3.7 inches.

Accordingly, the ribs 43 not only trap air within the choke cavity 42 for thermal insulation but also add to the efficiency of the choke.

While the protrusions or extensions 47 of the ribs 43 have been shown as engaging the lip 25 of the liner 19, it should be understood that such is not a requisite for satisfactory operation of the present invention. When the protrusions 47 of the ribs 43 engage the lip 25 of the liner 19, each of the protrusions 47 functions as an inductance. If the protrusions 47 of the ribs 43 are spaced from the lip 25, then each of the protrusions 47 functions as a capacitance. While there will be a slight amount of air flow if the protrusions 47 do not contact the lip 25, this would be a very small amount of flow of air and a large quantity of air would still be trapped between the ribs 43 within the choke cavity 42 and functions as a thermal insulator.

Referring to FIG. 3, there is shown another form of the present invention in which a metallic member 60 is used instead of the metallic member 40. The metallic member 60 extends completely around the liner 19 adjacent the lip 25 in the same manner as the metallic member 40.

The metallic member 60 has a portion 61 spaced from each of the walls 22–24 of the liner 19 to form a choke cavity 62 therebetween. The portion 61 of the metallic member 60 is spaced from each of the walls 22–24 of the liner 19 the same distance as the portion 41 of the metallic member 60.

The metallic member 60 has a rear mounting flange 63 at its end, which is remote from the lip 25 of the liner 19 and connected to the portion 61 by a connecting portion 64, which forms the rear wall of the choke cavity 62. The mounting flange 63 of the metallic member 60 is welded to each of the walls 22–24 of the liner 19 to connect the metallic member 60 to the liner 19.

The choke cavity 62 has rib inserts 65, which are completely separate from the metallic member 60, disposed therein at each of the groundpoints of the choke cavity 62. Each of the rib inserts 65 functions as a rib and has a protrusion or extension 66 at its end in engagement with the lip 25 and with a front mounting flange 67 of the metallic member 60.

As shown in FIG. 4, each of the rib inserts 65, which are welded to the metallic member 60, block the choke cavity 62. It is not necessary that the rib insert 65 engage the walls 22–≧of the liner 19 as there can be a slight space therebetween in the same manner as discussed relative to FIGS. 1 and 2. There also is a slight spacing of the end of the rib insert 65 from the portion 64 of the metallic member 60 shown in FIG. 3.

The front mounting flange 67 of the metallic member 60 is secured to the mounting flange 51 of the front wall 14 of the range 10. Thus, the oven liner 19 is secured to the front wall 14 of the range 10 by the metallic member 60.

The remainder of the structure of FIGS. 3 and 4 is the same as that shown and described for the embodiment of FIGS. 1 and 2.

While the ribs 43 have been shown and described as having the protrusions or extensions 47, and the rib inserts 65 as having the protrusions or extensions 66, as an alternative the extensions may be omitted. Such an alternative arrangement would be useful where a leakage monitor is employed, because the microwave energy circulation around the perimeter would permit the use of a single monitor.

An advantage of this invention is that it eliminates the requirement of a mullion heater in a pyrolytic self-cleaning oven. Another advantage of this invention is that it assists in controlling the leakage of energy from a microwave oven.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

We claim:

1. A combined microwave and self-cleaning oven including an oven liner having an opening, said liner having a lip surrounding the periphery of said opening, means to produce microwave energy of a selected wavelength within said liner, a door having sealing means engaging said lip when said door is in its closed position to seal said opening, a choke surrounding said liner adjacent said lip, said choke including a cavity with means to trap air therein to thermally insulate said liner adjacent said lip during pyrolytic self-cleaning of said liner, and to provide groundpoints.

2. The oven according to claim 1 in which said choke means includes a metallic member spaced from said liner the selected height to form said cavity therebetween, means to close said cavity at the end remote from said lip, and said metallic member terminating prior to said lip to have said opening rearwardly of said lip; and said trapping means includes means extending from said closing means toward said lip at each of the groundpoints in said cavity.

3. The oven according to claim 2 in which said extending means is integral with said metallic member.

4. The oven according to claim 3 in which said extending means engages said lip.

5. The oven according to claim 2 in which said extending means is separate from said metallic member and secured thereto.

6. The oven according to claim 5 in which said extending means engages said lip.

7. The oven according to claim 2 in which said extending means engages said lip.

8. The oven according to claim 1 in which said trapping means includes means disposed at each of the groundpoints in said cavity to substantially block air flow through said cavity.

9. The oven according to claim 8 in which the groundpoints are spaced from each other a distance approximately equal to one wavelength.

* * * * *